United States Patent [19]

Stengle, Jr.

[11] 4,316,930

[45] Feb. 23, 1982

[54] HEAT-RESISTANT COMPOSITE MATERIAL FOR HOT GLASS HANDLING AND METHOD OF MAKING SAME USING A PHENYL POLYSILOXANE COATING

[75] Inventor: Edward J. Stengle, Jr., Toledo, Ohio

[73] Assignee: Owens-Illinois, Inc., Toledo, Ohio

[21] Appl. No.: 200,177

[22] Filed: Oct. 24, 1980

[51] Int. Cl.[3] ..... B32B 17/04; B32B 17/10; B32B 27/12; B32B 33/00

[52] U.S. Cl. ..... 428/266; 65/374 R; 427/209; 427/387; 427/389.8; 428/268; 428/273; 428/303; 428/337; 428/920

[58] Field of Search ..... 428/266, 268, 273, 303, 428/337, 920; 427/209, 387, 389.8; 65/374 R

[56] References Cited

U.S. PATENT DOCUMENTS 4,246,313 1/1980 Stengle ..... 428/337

*Primary Examiner*—James C. Cannon

*Attorney, Agent, or Firm*—E. J. Holler; M. E. Click; D. H. Wilson

[57] ABSTRACT

This invention relates to a composite material, and method of making same, comprising a heat-resistant woven fabric substrate having a continuous heat and wear-resistant continuous coating thereon for handling hot glass articles, and the like, without marring same. The heat and wear-resistant composite material is formed from a tightly woven fabric, such as glass fibers, with a continuous imperforate coating of organic/inorganic silicone resin containing a filler of heat-resistant carbonaceous material adapted to withstanding extensive repeated contact with newly-formed hot glass articles. The composite material is preferably used as a facing material for a rigid structural backing member formed of metal.

14 Claims, 3 Drawing Figures

HEAT-RESISTANT COMPOSITE MATERIAL FOR HOT GLASS HANDLING AND METHOD OF MAKING SAME USING A PHENYL POLYSILOXANE COATING

CROSS-REFERENCE TO RELATED APPLICATIONS

A related U.S. patent application is entitled, "Improvements in the Manufacture of Glass Wherein Hot Metal Molds are Provided With a Solid Film Lubricant Layer," Ser. No. 562,554, filed March 27, 1975, now abondoned and refiled as Ser. No. 727,322, filed Sept. 27, 1976, the latter issued as U.S. Pat. No. 4,110,095 on Aug. 29, 1978, in the name of the same applicant and assigned to the same common assignee as the present application.

Another related U.S. patent application is entitled, "Heat Resistant Composite Material and Method of Making Same," Ser. No. 002,831, filed Jan. 12, 1979, in the name of the same applicant and assigned to the same common assignee as the present application, and now Pat. No. 4,246,313.

Still another related U.S. patent application is entitled, "Heat-Resistant Vacuum Pad and Method of Making Same", Ser. No. 196,419, filed Oct. 14, 1980, in the name of the same applicant and assigned to the same common assignee as the present application.

BACKGROUND OF THE INVENTION

1. Field of the Invention

This invention generally relates to relatively-rigid composite materials which are extremely heat-resistant, and methods of making same, which materials comprise a fibrous substrate having a continuous layer or coating of solid film lubricant or glass release agent which essentially comprises an organic/inorganic silicone resin having a finely-ground particulate filler therein. The layer or coating is formed by taking an organopolysiloxane resin or mixture of such resins in a solvent, and dispersing a prescribed amount of finely-ground graphite-containing material therein, the combined materials being applied to and heat cured on a woven fibrous substrate comprised of a heat-resistant material such as glass fibers, or similar high-temperature resistant fibrous substrate. The selected substrate in the form of a lengthy tape or ribbon, after coating, may be severed into precisely-sized and shaped contours, preferably subsequent to heat-curing the resin containing the filler material.

The composite material may be fabricated into coverings for sweep-out arms, pusher bars, curved-chain transfer mechanisms, and the like, for handling newly-formed, hot glass articles without marring their surfaces or creating objectionable emissions from the composite material due to excessive heat. The coating cures into a thermoset hardened condition fully dispersed through the fabric substrate, the substrate then being attached to a rigid metallic backing member for structural strength. Normally, the fibrous substrate, while possessing an appreciable amount of heat resistance, cannot be employed alone without a suitable heat-resistant coating for long-term, repeated handling of hot glass articles.

2. Description of the Prior Art

It has been commmon practice in the glass forming art to fabricate or cover conveyor belting and hot glass transfer mechanisms for transporting hot glass articles with asbestos or asbestos-containing materials such as transite to provide heatresistant surfaces which would not mar the glass and provide long-term operating life. Also, bucket liners and sweep-out arms have previously been fabricated with coverings of asbestos cloth for handling hot glass articles. Asbestos tapes have been used previously which are riveted to rigid backing members and then cut to shape dependent upon individual applications. It is desirable to eliminate the use of all asbestos in hot glass handling operations.

In the production of glassware, certain handling equipment has also been coated with graphite and petroleum oil swabbing compositions to provide lubricity and heat-resistance. In the use of such coatings, when the petroleum fraction flashes off, it can detract from effective lubrication during forming and emit undesirable emissions into the atmosphere.

The use of water-based carriers instead of the petroleum oil carriers for graphite and other lubricious materials have not been entirely satisfactory, primarily due to the high heat of vaporization of water and the resulting excessive cooling of the glass-handling equipment. It addition, it is difficult to controllably wet the handling equipment surface with water-based materials which are applied intermittently during production of glassware.

High temperature fabrics based on inorganic fibers such as glass, silica, quarts, and ceramics, have been proposed as replacement materials for asbestos for handling hot glass articles up to 1000° F. (538° C.). In glass manufacturing operations, such fabrics do not normally stand up well in repeated contact with hot glass articles because of their low resistance to abrasion. In the manufacture of glass fiber, for example, chemical treatments (sizings) such as acrylic resin or starch are used to reduce abrasive contact and fiber breakage during processing. These are organic and burn off in a high temperature environment such as in handling hot glass articles resulting in surface abrasion at the product/fabric interface and also within the fabric. Fabrics based on inorganic fibers exhibit the necessary heat resistance for hot glass handling; however, such materials require a combination with high temperature solid lubricant coating technology to be functional. This has been accomplished by the present invention and coated glass fabrics have been developed which exhibit an acceptable service life in handling hot glass articles such as by conveyor ware transfer mechanisms.

SUMMARY OF THE INVENTION

The present invention comprises a composite material including a cured, thermoset, organopolysiloxane resin containing a filler of heat-resistant particulate material which is applied over a tightly-woven, thick fabric comprised of thin glass fibers. The invention relates to generally rigid composite material which is extremely heat-resistant, and methods of making same, which material has at least one continuous layer or coating of solid film lubricant or glass release agent which essentially comprises an organopolysiloxane resin having a major portion of a finely-ground, graphite-containing particulate filler therein. The combined coating constituents are applied over and through a lengthy woven fibrous substrate composed of glass fiber tape, tubing, and the like, and heat-cured thereon. The tape substrate may be preliminarily severed into precisely-sized and shaped lineal lengths prior to applying the coating and heat-curing the resin containing the filler material for its use as a covering over another rigid surface. The layer or coating composition is formed of a solid film lubricant which essentially comprises a finely-divided, heatresistant filler dispersed in a silicone resin-alcohol solution. The layer or coating is formed by introducing the dispersion of a fine graphite and carbon-containing filler into an organic solution of a curable, thermosettable, organopolysiloxane resin which is applied over and through the woven glass fiber cloth substrate, and then the organopolysiloxane resin is cured into a thermoset hardened condition.

Accordingly, an object of the present invention is to provide an improved hot glass handling impregnated tape material.

Another object of the present invention is to provide a composite material which provides long-term effectiveness in repeated contact with newly-formed hot glass articles in the form of an impregnated fiber glass tape.

Another object of the present invention is to provide improved hot glass handling capability to existing hot glass handling devices, and the like, by providing a relatively-rigid heat-resistant fibrous glass tape with a continuous graphitefilled organopolysiloxane resin coating therethrough adapted to cover the glass contacting surfaces of such equipment.

Yet another object of the present invention is to provide a method of making a high-heat-resistant glass fiber tape which is capable of repeated contact with hot glass articles over an extensive period without deterioration of the material or deleterious marking of the glass articles.

Still another object of the present invention is to provide a heat and wear-resistant woven fabric substrate having a continuous coating of silicone resin and finely-divided graphite and carbon filler thereon in cured thermoset hardened condition adapted to long-term serial handling of newly-formed hot glass articles.

These and other objects and features of the present invention will become apparent from the following detailed description.

DETAILED DESCRIPTION OF THE PREFERRED EMBODIMENT

Figure 1:
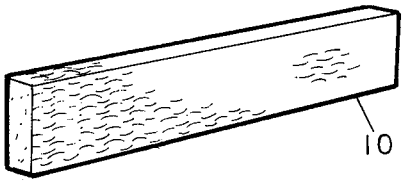
FIG. 1 is a perspective view of lengthy impregnated glass fiber tape for handling hot glass articles.

The base material upon which the combined coating composition is applied is preferably comprised of glass fiber tape or tubing, which is commercially manufactured and sold under the trademark "Textoglass", by the J. P. Stevens & Co., Inc. Industrial Fabrics Dept., New York, N. Y. Such glass fiber tape is commonly fabricated in a variety of widths and made into a variety of special industrial products exhibiting high modulus of rupture. Among the more significant characteristics of glass fiber tape or tubing are high tensile strength resistance to combustion and flame retardancy, resistance to stretch, and good surface abrasion resistance. The material is useful over a wide range of temperatures without deterioration or degradation and has a thermal conductivity generally similar to asbestos fibers.

A preferred form of the tape material is J. P. Stevens Style No. 1906, Finish No. 9383, which is a twill weave. This material is made from 0.00018 inch diameter glass fibers, has a weight of 26.5 ounces per square yard, and a thickness of 0.045 inch. The minimum average breaking strength in pounds per inch of width is 430 warp and 230 fill. The glass fibers can be employed to weave thick fibrous tape up to about 12 inches in width which may be used as conveyor belting covering for hot glass transfer mechanisms, and insulating cloth or pads. The material possesses very good thermal resistance, as well as excellent chemical resistance to most common chemicals. Glass tape based on a "C" filament having 0.00018 inch diameter is preferred for reasons of this diameter being safer from the standpoint of skin sensitivity problems. The material may be a tape or tubing having the aforesaid physical properties. Generally, similar tape and tubing materials can be obtained from Carolina Narrow Fabrics Co., Winston-Salem, N.C.

The glass fibers can be woven into tightly, interwoven tape or tubing having a thickness of less than about $\frac{1}{4}$ inch. Various thicknesses of the glass fiber tape can be employed as the substrate, the tubing having a lesser thickness. Other materials can be employed as the substrate so long as they possess high temperature resistance to degradation and can be fabricated into interwoven fibrous tape or tubing. Among such other materials which may be used as the flexible substrate are ceramic fiber tape or tubing, such as manufactured by the Carborundum Company, and carbon fabric manufactured by American Kynol, Inc., all of which are comprised of high-temperature resistant fibers or yarn adapted to be fabricated into tape or tubing.

The carbon tape or tubing is essentially a phenolic fiber, known as carbonized Kynol, or Kynol novoloid precurser fiber, which is formed by formaldehyde curing of melt-spun novolac resin. Curing results in the formation of methylol groups, dimethyl ether bonds, and methylene bonds, and because of its three dimensionally cross-lined structure, the fiber thus obtained is infusible. The fiber is capable of being carbonized directly, without the need for intermediate infusibility treatment.

The ceramic fiber tape or tubing may be comprised of Fiberfrax ceramic fiber which in textile form contains 15 to 25% organic fiber added during the carding process to produce roving. Such textiles have superior insulating ability to 2300° F. (1260° C.), and excellent resistance to thermal shock, corrosive attack, and breakdown due to mechanical fibration and stress. They are available from the Carborundum Company. The materials can be double woven to provide exceptional strength and be heattreated to remove all organics.

The glass fiber tape or tubing is easily able to withstand temperatures as high as 1200° F. (650° C.). Such material in fabric form is able to maintain high tensile strength while resisting thermal shock and abrasion. Such fibers are composed of borosilicate glass and offer much better dimensional stability than amorphous silica fibers.

EXAMPLE NO. I

A preferred example of the coating composition which may be employed to coat the woven glass fiber substrate with a heat and wear-resistant layer to be contacted by the hot glass consists of the following constituents:

| RANGE (Parts by Weight) | PREFERRED AMOUNT (Parts by weight) | COMPONENT | CONSTITUENT |
|---|---|---|---|
| 50 to 60 | 50 | (A) | Polysiloxane Glass Resin Polymer - O-I PRODUCT No. T-950 Regular |
| 40 to 50 | 50 | (B) | Low Molecular Weight Alcohol |
| 5 to 15 | 5 | (C) | Finely-divided Graphite Union Carbide Product No. 38 |
| 5 to 15 | 5 | (D) | Barnebey-Cheney XZ Grade Activated Charcoal |

The coating composition is a dispersion of finelydivided graphite and activated charcoal in a silicone resinalcohol solution.

The Owens-Illinois Glass Resin Polymer, Product No. T-950 Regular, Component (A), is an organopolysiloxane resin designed for high temperature laminating applications which require considerable retained flexural and impact strength when the laminate is exposed to elevated temperatures for a prolonged period of time. The subject organopolysiloxane resin is a 100% trifunctional polyphenyl organosiloxane produced by the cohydrolysis and co-condensation of different alkoxysiloxanes employing the steps of: (a) heating the reaction mixture to form a partial condensation product, (b) concentrating this product, (c) precuring the concentrated product, and (d) finally curing the precured product. The resins are useful as machinable, heat-resistant, thermoset bodies, or as coatings. Generally similar resins and processes of making same are disclosed and claimed by U.S. Pat. No. 3,389,121 to Burzynski and Martin, issued June 18, 1968, assigned to the same common assignee as the present invention.

The following properties are typical of Owens-Illinois Glass Resin No. T-950 Regular:

| | |
|---|---|
| Physical Form | Solid-Flake |
| Solid Content | 100% |
| Softening Point | 70°-80° C. |
| Flash Point - Closed Cup | 170° C. |
| Shelf Life | Minimum 6 mos. at room temperature |

The flake resin is fully soluble in the following solvents: Benzene, xylene, tetrahydrofuran, acetone, diethyl ether, ethanol, chloroform, and ethylenedichloride.

Product No. T-950 Regular flake can be incorporated into most conventional molding compounds including silicones, polyesters, epoxies, or mixtures of these materials. 950 flake is incorporated into molding compounds by using conventional wet blending, dry blending, or milling techniques. It is normally added at a 5-20% by weight ratio; however, some applications have utilized as much as 30-40% of the flake. The resin is primarily comprised of phenyl silicone groups.

The low molecular weight alcohol, Component (B), is a lower alcohol such as ethanol, isopropanol or butanol, with ethanol being preferred.

Dry particulate graphite is intimately combined with the organopolysiloxane resin and alcohol to form a dispersion of lubricant filler material therein. The weight ratio of the graphite to the organopolysiloxane resin solids in forming the dispersion is preferably on the order of about 1 to 3 to about 1 to 10. A weight percentage of about 4.5 percent is most beneficial. Where greater lubricity is desired in the final cured coating, a higher ratio of graphite to organopolysiloxane resin solids is used, the graphite serving as a lubricant. In some cases of the aforesaid example where higher lubricity is desired, up to 25% graphite may be employed. A particularly useful graphite, Component (C) employed in the subject coating consists of Union Carbide Product No. 38, manufactured and sold by Union Carbide Chemical Company. In general, such graphite is described as electic furnace, or synthetic, graphite having a particle size ranging from 44 to 70 microns.

Component (D) which is a filler material comprises an activated charcoal in particulate form, one desirable product being XZ grade activated charcoal which is available from Barnebey-Cheney Company, Columbus, Ohio. Such product has a particulate size of essentially all passing through 325 U. S. mesh. The combined material has fine particle size and heat-resistance which can more effectively coat the very fine diameter glass fibers (0.00018 inch). The fine graphite serves a lubricant purpose and the charcoal serves a structural purpose. Glass fabrics frequently exhibit very poor abrasion resistance and must be coated to reduce friction and develop wear-resistance if they are to be functional in high temperature applications.

The silicone resin is used as a high temperature binder phase for the dispersed graphite and activated charcoal. A low solids in alcohol solution (50 percent by weight) is used to develop a reasonably-rigid coating, one which can slightly flex under impact abuse with hot glass which is at about 900° F. in temperature. The high temperature silicone resin encapsulates the glass fabric and in combination with the graphite and charcoal lubricant provides a solid lubricant-glass release structure which is functional under repeated impact cycles when contacted by hot glass articles.

The above-described coating composition is applied over the full width and length of fibrous tape or tubing substrate in the form of a continuous imperforate layer by various techniques, such as brushing, spraying or dipping. Preferably, the coating is applied over both surfaces of the substrate to obtain a full impregnation of the fabric. The coating on the substrate is cured by heating in an air-circulating oven for about one hour at 500° F. to 600° F. (260° C. to 315° C.) with the higher limit being preferred. Following such curing, the coating is very adherent to the substrate and fully penetrates the pores and interstices of the fabric, making it relatively rigid. In the case where organic processing aids are used on the fabric, or on the yarn or roving for making the fabric, the organic coating on the fibers of the fabric from their manufacture must be burned off prior to coating as aforesaid. The fabric exhibits a relatively-greater stiffness when the coating is cured on heating to a hardened thermoset condition. The woven fabric tape or tubing can be cut to shape, assembled and coated, or the coated fabric tape can be cut to the shape of a backing member.

Figure 2:
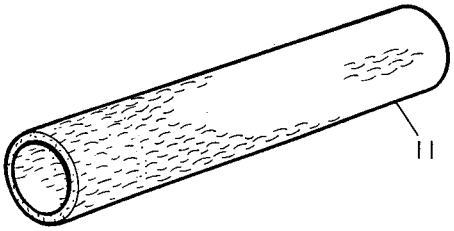
FIG. 2 is a perspective view of lengthy impregnated glass fiber tubing for the same purpose.
Figure 3:
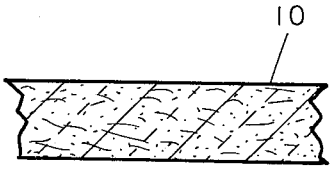
FIG. 3 is an enlarged vertical sectional view of the glass fiber tape shown in FIG. 1.

The glass fiber tape 10 is shown in FIG. 1 of the drawing having a lengthy configuration. Glass fiber tubing 11 is shown in FIG. 2 having lengthy configuration. The fibrous tape of glass fiber cloth has a width of about 3 to 4 inches. Both the tape and the tubing are formed in great length in roll form, permitting them to be cut to desired length before or after coating.

The coated fabric tape or tubing is usuallly attached to a rigid base plate, such as a cast steel plate used for handling newly-formed glassware. The coated fabric on the base plate in the form of a cushioning pad serves to protect the hot glassware against defects and as a glass release agent. The exterior surface of the coating on the fabric provides good lubricity with low friction and excellent heat-resistance for repeated direct contact with hot glass. The pad is able to support or contact hot glass articles without marring or marking of the glass surfaces, and without any pick-up of residue which might deleteriously affect the appearance or structural strength of the articles. The coated tape in the form of a pad can be riveted or adhesively bonded to the rigid backing plate. The coated tubing can be telescoped over a steel rod or bar to provide a guide member for hot glass articles. The coating is fully cured into solidified thermoset condition and has no tackiness to detract from its usefulness over a wide range of high-temperature applications. The polysiloxane resin and carbonaceous filler constituents of the coating on curing are essentially solventless and do not emit vaporized solvents or create any other emissions on use.

The method may be practiced as follows: The coating is applied, such as by brushing or dipping, in sufficient amount to fully penetrate the complete thickness and interstices of the cloth. The coating is then cured by heating within the stated range of 500° F. to 600° F. for a period of about one to two hours. The resulting relative stiffness of the laminated tape may then be broken as desired by bending the tape to fit the contour of the backing plate. As stated, it is normally attached thereto by riveting or with a high-temperature adhesive. When so attached, the pad must be able to provide a cushioning effect for the glassware without evidencing physical damage.

Various modifications may be resorted to within the spirit and scope of the appended claims.

I claim:

1. A heat-resistant, relatively-rigid, composite material adapted to handling hot glass articles, and the like, comprising a tightly interwoven fabric substrate formed from extremely thin glass fibers, and a continuous heat-cured coating of essentially all phenyl polysiloxane resin having a finely-divided filler of heat-resistant particulate carbonaceous material therein extending over the glass-contacting surface and fully penetrating the said substrate.

2. A heat-resistant, relatively-rigid, composite material in accordance with claim 1, wherein said fabric substrate has a thickness of not more than about ¼ inch.

3. A heat-resistant, relatively-rigid, composite material in accordance with claim 1, wherein said continuous heat-cured coating of polysiloxane resin and filler comprises an imperforate layer fully penetrating the interstices of said fabric substrate.

4. A heat-resistant, relatively-rigid, composite material in accordance with claim 1, wherein said finely-divided filler of heat-resistant particulate carbonaceous material comprises graphite and activated charcoal.

5. A heat-resistant, relatively-rigid, composite material in accordance with claim 1, wherein said fabric substrate is comprised of glass fibers having a diameter of about 0.00018 inch.

6. A heat-resistant, relatively-rigid composite material in accordance with claim 1, wherein said coating of polysiloxane resin is comprised of phenyl silicone resin dissolved in alcohol.

7. A heat and wear-resistant, relatively-rigid composite material adapted to handling hot glass articles, and the like, comprising a tightly interwoven fabric substrate formed from glass fibers, and a continuous heat-cured coating of essentially all phenyl polysiloxane resin having a finely-divided filler of particulate graphite and activated charcoal material therein extending over the glass-contacting surface and fully penetrating said substrate, said coating, prior to curing, being comprised of about 50 to 60 parts by weight polysiloxane resin, about 40 to 50 part by weight low molecular weight alcohol, about 5 to 15 parts by weight finelydivided graphite filler material, and about 5 to 15 parts by weight activated charcoal filler material.

8. A heat and wear-resistant, relatively-rigid, composite material adapted to handling hot glass articles, and the like, comprising a tightly interwoven impregnated fabric substrate formed from glass fibers, and a continuous heat-cured coating of essentially all phenyl polysiloxane resin having a finely-divided filler of particulate graphite and activated charcoal material therein extending at least over the glass-contacting surface of said substrate, said coating, prior to curing, being comprised of about 50 parts by weight polysiloxane resin, about 50 parts by weight low molecular weight alcohol, about 5 parts by weight finely-divided graphite, and about 5 parts by weight activated charcoal.

9. The method of making a heat-resistant, relatively-rigid composite material adapted to handling hot glass articles, and the like, comprising the steps of cutting to size a lengthy ribbon of tightly interwoven flexible fabric substrate comprised of extremely thin glass fibers, coating both surfaces of said fabric substrate with a continuous layer of essentially all phenyl polysiloxane resin having a finely-divided filler of heat-resistant particulate carbonaceous material therein, and heat-curing the said layer of polysiloxane resin and carbonaceous filler fully penetrating the said fabric substrate into a relatively-rigid structure.

10. The method in accordance with claim 9, including the step of heat-curing the said coating at a temperature of about 500° F. over a period of about one hour.

11. The method in accordance with claim 9, including the step of coating both surfaces of said fabric substrate with a composition comprised of about 50 to 60 parts by weight polysiloxane resin, about 40 to 50 parts by weight low molecular weight alcohol, about 5 to 15 parts by weight finely-divided graphite filler material, and about 5 to 15 parts by weight activated charcoal filler material.

12. The method in accordance with claim 9, including the step of cutting to size a lengthy ribbon of tightly interwoven glass fiber cloth having a width of about 3 to 4 inches comprised of glass fibers having a diameter of about 0.00018 inch.

13. The method in accordance with claim 9, including the step of coating the fabric substrate with a polysiloxane resin comprised of phenyl silicone resin dissolved in a lower molecular weight alcohol.

14. The method in accordance with claim 9, including the step of heat-curing the said layer of polysiloxane resin and filler material into relatively-rigid durable condition, adapted to withstand physical abuse by hot glass articles.

* * * * *